US011145280B2

(12) United States Patent
Shibuya

(10) Patent No.: US 11,145,280 B2
(45) Date of Patent: Oct. 12, 2021

(54) ELECTRIC STRING INSTRUMENT

(71) Applicant: HOSHINO GAKKI CO., LTD., Aichi (JP)

(72) Inventor: Naoki Shibuya, Nagoya (JP)

(73) Assignee: HOSHINO GAKKI CO., LTD., Aichi (JP)

( * ) Notice: Subject to any disclaimer, the term of this patent is extended or adjusted under 35 U.S.C. 154(b) by 0 days.

(21) Appl. No.: 16/858,715

(22) Filed: Apr. 27, 2020

(65) Prior Publication Data

US 2021/0158786 A1 May 27, 2021

(30) Foreign Application Priority Data

Nov. 25, 2019 (JP) ..... JP2019-212050

(51) Int. Cl.
*G10D 3/153* (2020.01)
*G10D 3/22* (2020.01)
*G10D 1/08* (2006.01)

(52) U.S. Cl.
CPC ..... *G10D 3/153* (2020.02); *G10D 1/085* (2013.01); *G10D 3/22* (2020.02)

(58) Field of Classification Search
CPC ..... G10D 3/153; G10D 3/22; G10D 1/085
USPC ..... 84/313
See application file for complete search history.

(56) References Cited

U.S. PATENT DOCUMENTS 3,686,993 A * 8/1972 Fender ..... G10D 3/147 84/312 R
4,177,847 A * 12/1979 Spindler ..... G10G 7/00 150/162
5,391,833 A * 2/1995 Clement ..... G10H 3/18 84/742
5,929,362 A * 7/1999 Oteyza ..... G10H 1/32 84/743
6,051,773 A * 4/2000 Rose ..... G10H 3/18 84/743
6,649,817 B2 * 11/2003 Hartill ..... G09F 7/00 84/267
8,455,750 B1 * 6/2013 Severson ..... G10H 1/32 84/743
9,466,269 B2 * 10/2016 Brown, Jr. ..... G10H 3/181
9,697,807 B2 * 7/2017 Brown, Jr. ..... G10D 3/153
10,607,579 B1 * 3/2020 Louscher ..... G10D 1/085
10,902,826 B1 * 1/2021 Brock ..... G10D 3/02
2010/0024622 A1 * 2/2010 Kim ..... H01F 7/0252 84/291

(Continued)

FOREIGN PATENT DOCUMENTS

JP 2014-206698 A 10/2014
WO 2019068953 A1 4/2019

OTHER PUBLICATIONS

Extended European Search Report dated Oct. 5, 2020 issued in European Patent Application No. 20171502.6.

*Primary Examiner* — Christina M Schreiber

(57) ABSTRACT

An electric guitar includes a body, a neck, and a tremolo device. A tremolo cavity for accommodating a tremolo spring is formed on the back of the body. A metal cover is attached to the tremolo cavity so as to cover the tremolo spring from the outside. A magnetic force generating portion that generates a magnetic force for fixing the metal cover to the body is provided in the vicinity of the tremolo cavity.

8 Claims, 7 Drawing Sheets

(56) References Cited

U.S. PATENT DOCUMENTS

| | | | | |
|---|---|---|---|---|
| 2015/0199948 | A1* | 7/2015 | Fishman | G10H 3/18 84/726 |
| 2015/0356955 | A1* | 12/2015 | Brown, Jr. | G10H 3/18 84/267 |
| 2016/0247498 | A1* | 8/2016 | Fishman | G10H 3/186 |
| 2016/0372089 | A1* | 12/2016 | Tully | G10H 1/32 |
| 2017/0025102 | A1* | 1/2017 | Brown, Jr. | G10H 3/18 |
| 2017/0053631 | A1* | 2/2017 | Strassell | G10H 3/181 |
| 2017/0084262 | A1* | 3/2017 | Selmo | H03F 3/183 |
| 2017/0337907 | A1* | 11/2017 | Kung | G10D 3/02 |
| 2018/0061380 | A1* | 3/2018 | Berg | G10D 1/085 |
| 2020/0265810 | A1* | 8/2020 | Planet Ylla | G10D 1/085 |
| 2021/0158786 | A1* | 5/2021 | Shibuya | G10D 3/153 |

* cited by examiner

ELECTRIC STRING INSTRUMENT

BACKGROUND

1. Field of the Invention

The present invention relates to an electric string instrument that converts a vibration of a string into an electric signal and outputs the electric signal.

2. Description of the Related Art

Examples of electric string instruments include electric guitars, electric bass guitars, and electric violins. An electric string instrument is used while being connected to an amplifier using a cable in order to electrically amplify a vibration of a string of the electric string instrument and output the amplified vibration. Therefore, the electric string instrument is provided with a pickup for converting vibrations of strings into electric signals, a jack into which a terminal plug of the cable is inserted, knobs operated to adjust tones and volumes, and the like.

Some electric guitars have a tremolo arm that is operated by arming technique that continuously shakes a vibrating sound of a string. These types of electric guitars have not only electronic components such as switches and wiring but also a plurality of springs that are coupled to the tremolo arm and mounted on the back of a body. Therefore, on the back of the body are formed a spring accommodating recessed portion called "tremolo cavity" and an electronic component accommodating recessed portion called "control cavity."

In addition, dedicated covers are attached to the tremolo cavity and the control cavity so as to cover the springs and electronic components from the outside. As disclosed in, for example, Japanese Laid-Open Patent Publication No. 2014-206698, typically the tremolo cavity cover and the control cavity cover are directly fixed to the body using screws. For this reason, insertion holes into which the screws are inserted are formed at corners of the tremolo cavity cover and the control cavity cover. Screw holes into which the screws are screwed are formed at cover mounting positions of the body.

For the purpose of tuning and maintenance, a user of the electric guitar often replaces the tremolo springs or electronic components and adjusts the tensions of the tremolo springs. In so doing, since such work is performed after the covers are removed, all screws fixing the covers to the body need to be removed using a tool such as a screwdriver. Moreover, after the work is done, all the screws need to be tighten using a tool, to attach the covers. For the user, such tasks as loosening and tightening the screws every time when performing tuning or maintenance are complicated and troublesome.

Repeatedly attaching or removing the covers can sometimes result in crushing and expansion of tool holes formed on the screws with which the tool is engaged or the screw holes formed on the body. As a result of the tool holes of the screws being crushed and expanded, it becomes difficult to turn the screws with the tool. Consequently, it takes longer to attach and remove the covers, making such tasks as tuning and maintenance more complicated and troublesome. Moreover, as a result of the screw holes on the body being crushed, the strength of the screws for fixing the covers to the body becomes weak. Consequently, the covers easily come off during a live performance involving strenuous movements.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one aspect, an electric string instrument that converts a vibration of a string into an electric signal and outputs the electric signal is provided. The electric string instrument has a body on which the string is stretched, and a component provided on the body and used for outputting the electric signal or playing the electric string instrument. The body has a component accommodating recessed portion for accommodating the component, a cover attached to the component accommodating recessed portion, and a magnetic force generating portion that generates a magnetic force for fixing the cover to the body.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

The electric string instrument according to the present invention is described hereinafter with reference to FIGS. 1 to 6 with respect to an embodiment incorporating an electric guitar 10 (referred to as "electric guitar," hereinafter).

Figure 1:
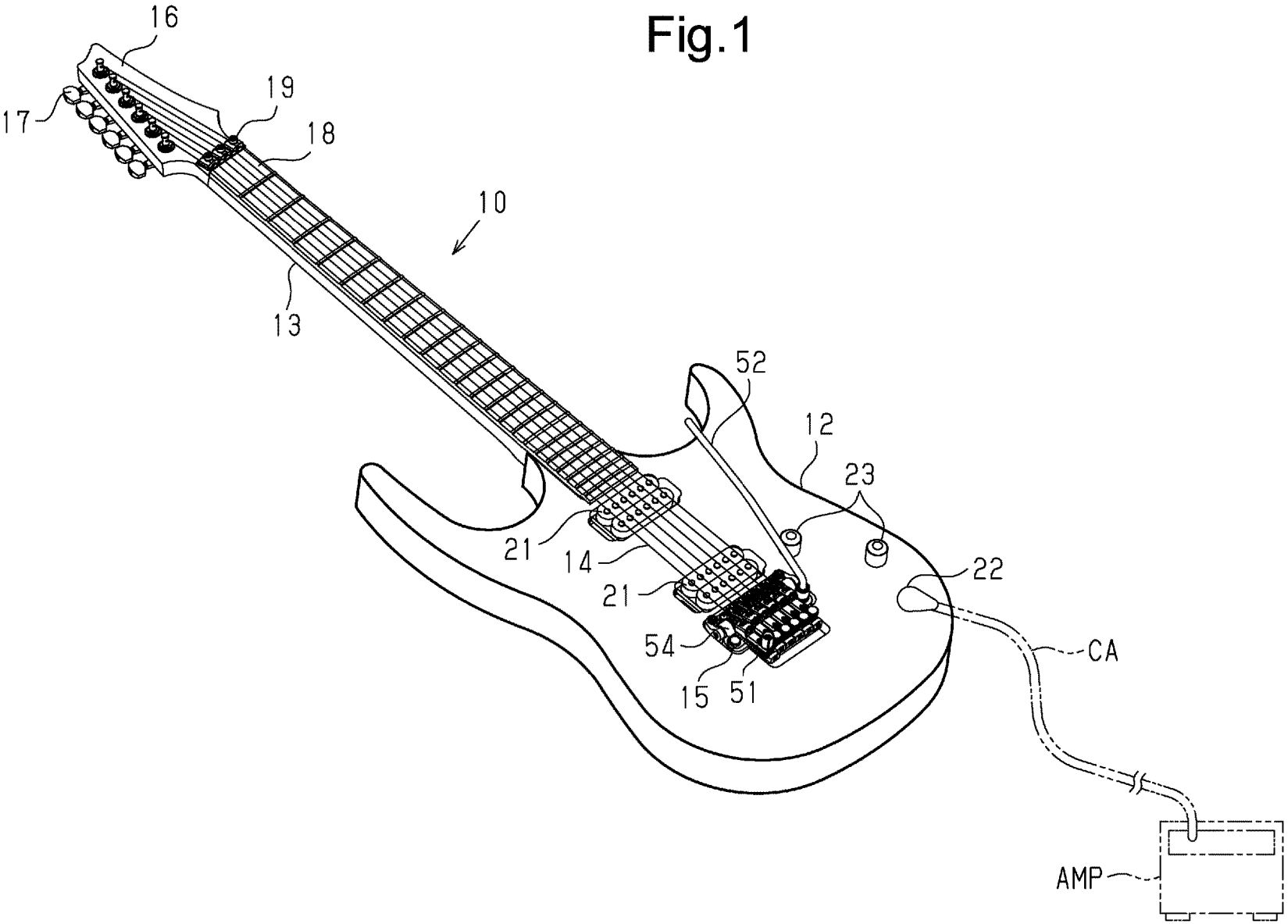
FIG. 1 is a perspective view showing the front of an electric guitar according to an embodiment of the present invention.
Figure 2:
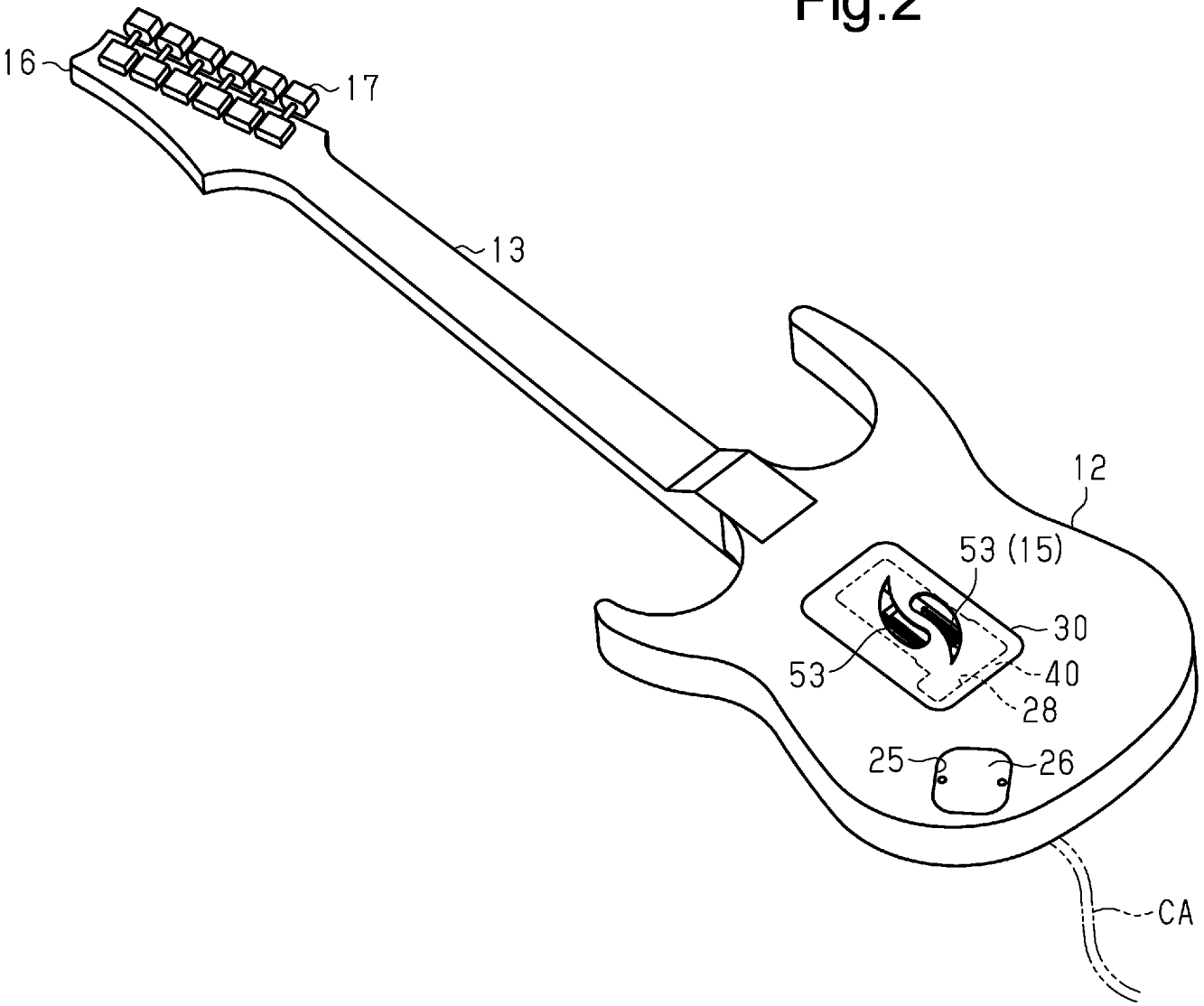
FIG. 2 is a perspective view showing the back of the electric guitar.

As shown in FIGS. 1 and 2, the electric guitar 10 includes a body 12, neck 13, six strings 14, and a tremolo device 15. In the present embodiment, the electric guitar 10 is created for right-handed performers. The tremolo device 15 consists of a plurality of components which are formed as a set by assembling components such as a tremolo block 51, a tremolo arm 52, and a tremolo spring 53. The tremolo device 15 is used in arming technique that continuously shakes vibrating sounds of the strings 14.

The tremolo block 51 is attached substantially in a center of the body 12. The tremolo arm 52 is attached on the tremolo block 51. The tremolo arm 52 is a member operated when performing the arming technique and is formed into the shape of a rod. A bridge 54 supporting base ends of the strings 14 and a tailpiece to which the base ends of the strings 14 are fixed, are attached on the tremolo block 51.

The neck 13 extends from the body 12 to the left. A head 16 is mounted at a tip of the neck 13. Six tuning pegs 17 are arranged in a line and attached to the head 16. Tips of the strings 14 are wound and fixed around the respective tuning pegs 17. The electric guitar 10 is tuned by turning the tuning pegs 17 to change the tensions of the strings 14.

A fingerboard 18 is attached to a front surface of the neck 13. At the tip portion of the neck 13, a nut 19 is attached adjacent to a left end of the fingerboard 18. The nut 19, together with the bridge 54, supports each of the strings 14 away from the fingerboard 18. In this state, each of the strings 14 is stretched across the neck 13 and the body 12, between the body 12 and the bridge 54.

The electric guitar 10 is used while being connected to an amplifier AMP using a cable CA in order to electrically amplify vibrations of the strings 14 and output the amplified vibrations. Therefore, a pickup 21 for converting the vibrations of the strings 14 to electric signals are attached to a front surface of the body 12. The pickup 21 is disposed in the vicinity of the center of the body 12, as well as the vicinity of a boundary between the body 12 and the neck 13. In addition, a jack 22 into which a terminal plug of the cable CA is inserted, knobs 23 operated to adjust tones and volumes, and the like, are attached to the front surface of the body 12.

Figure 3:
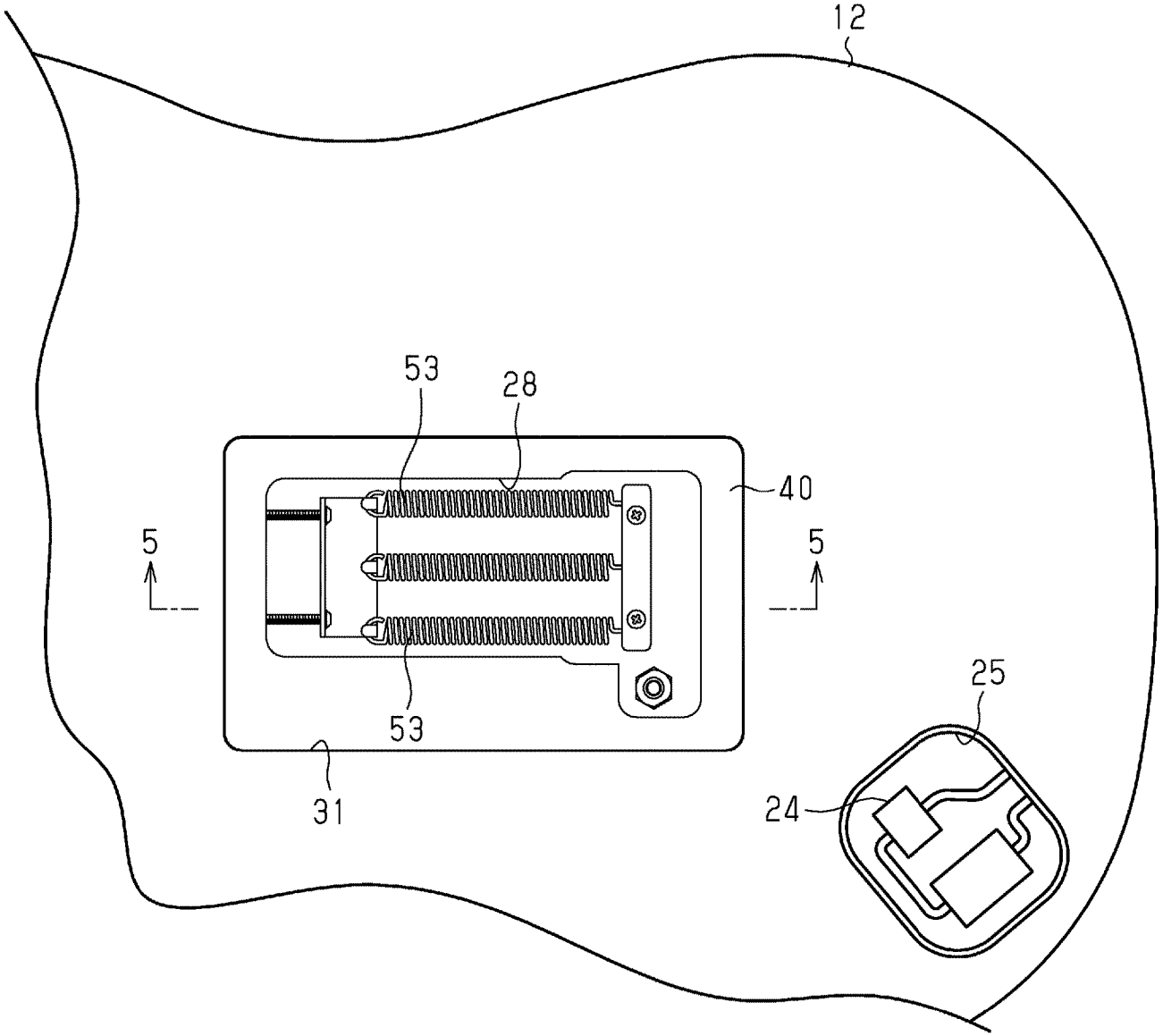
FIG. 3 is a partial plan view showing an enlargement of the vicinity of a tremolo cavity of the electric guitar.

As shown in FIGS. 2 and 3, a control cavity 25 is formed as a component accommodating recessed portion on the back of the body 12. Electronic components 24 for converting the vibrations of the strings into electric signals and outputting the electric signals are accommodated in the control cavity 25. The electronic components 24 include electric wiring for connecting the pickup 21 and the jack 22, switches connected to the knobs 23, and the like. The control cavity 25 is formed at a position corresponding to the jack 22 shown in FIG. 1, that is, in the vicinity of a right end portion of the body 12. When planarly viewed, the control cavity 25 has a substantially square shape with rounded corners.

A resin control cavity cover (referred to as "resin cover," hereinafter) is attached to the control cavity 25 so as to cover the electronic components 24 from the outside. The resin cover 26 is fixed to a rear surface of the body 12 by a pair of screws. The resin cover 26 is attached to or removed from the control cavity 25 by loosening or tightening the screws using a tool such as a screwdriver. When, for example, repairing the electronic components 24 or replacing the electronic components 24 to new ones, the resin cover 26 is removed from the control cavity 25.

A tremolo cavity 28 is formed as a component accommodating recessed portion on the back of the body 12. A plurality of tremolo springs 53 are accommodated in the tremolo cavity 28. The tremolo springs 53 are coupled to the tremolo arm 52 via the tremolo block 51. A tension adjustment mechanism 29 that is operated to adjust tensions of the tremolo springs 53 is accommodated in the tremolo cavity 28. The tremolo cavity 28 is formed at a position corresponding to the tremolo block 51 shown in FIG. 1, that is, roughly in the center of the body 12. When planarly viewed, the tremolo cavity 28 has a substantially rectangular shape.

A metal tremolo cavity cover (referred to as "metal cover," hereinafter) is attached to the tremolo cavity 28 so as to cover the tremolo springs 53 from the outside. The metal cover 30 is fixed to the rear surface of the body 12 by a magnetic force acting between the metal cover 30 and the tremolo cavity 28. The metal cover 30 is attached to the control cavity 25 by being placed so as to cover the control cavity 25. The metal cover 30 is also removed from the control cavity 25 in such a manner as to be pulled away from the body 12. The metal cover 30 is removed from the tremolo cavity 28 not only when, for example, replacing the tremolo springs 53 but also when adjusting the tensions of the tremolo springs 53.

Figure 4:
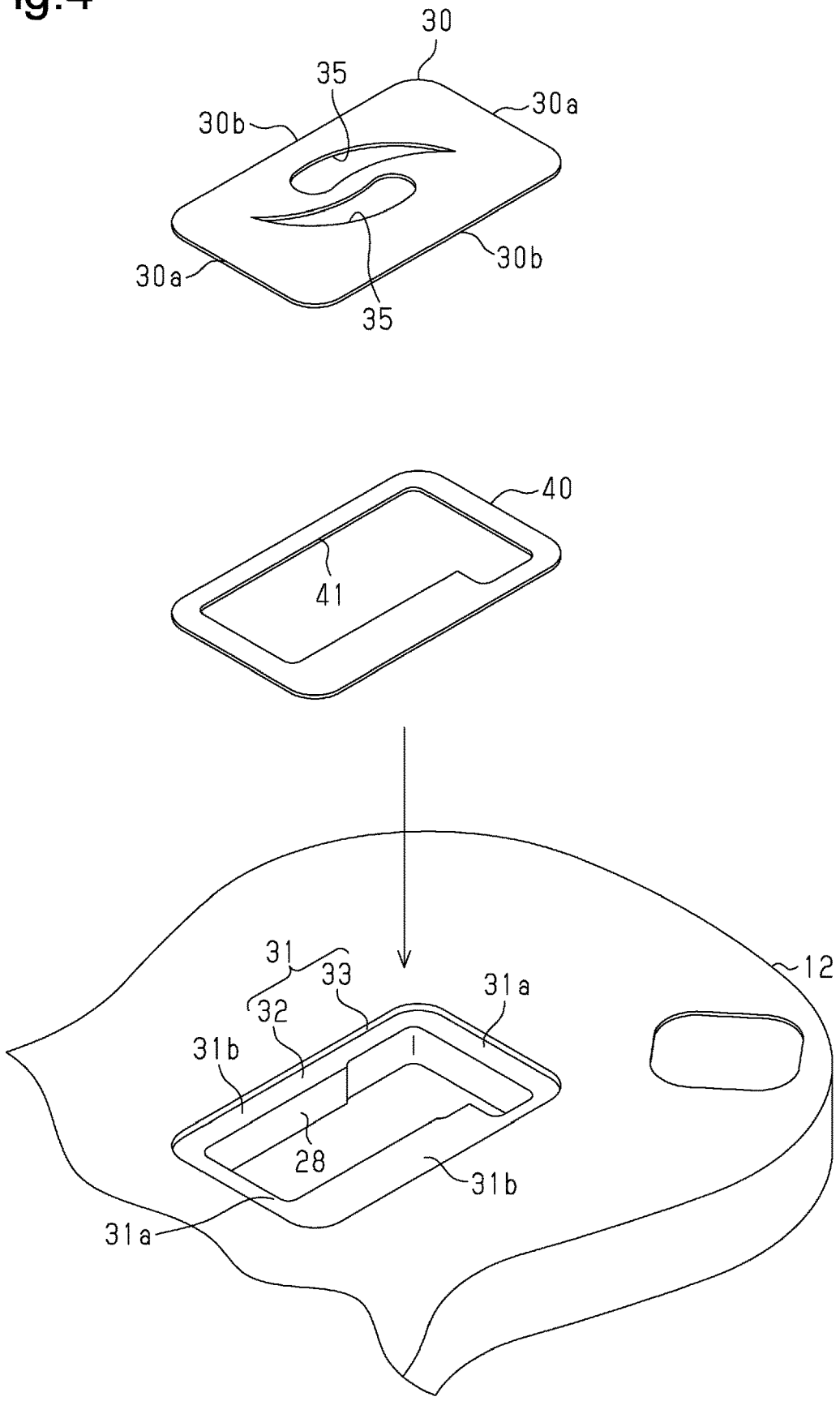
FIG. 4 is a perspective view of the tremolo cavity, a magnetic force generating portion, and a metal cover.

As shown in FIGS. 3 and 4, a cover placement recessed portion 31 in which the metal cover 30 is disposed is formed on the back of the body 12. The cover placement recessed portion 31 is provided along the entire circumference of the tremolo cavity 28. The cover placement recessed portion 31 is constituted by a bottom wall 32 facing a rear surface of the metal cover 30, and a side wall 33 facing an outer peripheral surface of the metal cover 30. The cover placement recessed portion 31 is formed into the shape of a frame constituted by a pair of first recessed portions 31*a* corresponding to short sides 30*a* of the metal cover 30, and a pair of second recessed portions 31*b* corresponding to long sides 30*b* of the metal cover 30.

A magnetic force generating portion 40 that generates a magnetic force for fixing the metal cover 30 to the body 12 is provided in the vicinity of the tremolo cavity 28. The magnetic force generating portion 40 is made out of a magnetic sheet. The magnetic sheet is formed by mixing ferrite (iron oxide) powder composed of a ferromagnetic material with a resin such as chlorinated polyethylene and molding this mixture into a sheet. The magnetic sheet has the magnetic force of ferrite and flexibility of the resin.

The magnetic force generating portion 40 is formed by cutting a commercially available magnetic sheet into the same shape as a planar shape of the cover placement recessed portion 31. Therefore, the magnetic force generating portion 40 has an opening 41 that is in the same shape as the planar shape of the tremolo cavity 28. The magnetic force generating portion 40 is provided with a desired magnetic force by adjusting the amount of ferrite powder contained in the magnetic sheet. The magnetic force of the magnetic force generating portion 40 is large enough to easily attach and detach the metal cover 30 to and from the tremolo cavity 28, and specifically is set at approximately ½ to ¼ that of a ferrite magnet.

The magnetic force generating portion 40 is provided so as to cover the entire surface of the bottom wall 32 of the cover placement recessed portion 31. The magnetic force generating portion 40 is fixed onto the bottom wall 32 of the cover placement recessed portion 31 by using a bonding material such as an adhesive or a double-sided tape. In a state in which the magnetic force generating portion 40 is fixed to the cover placement recessed portion 31, an inner peripheral edge of the magnetic force generating portion 40 matches an inner peripheral edge of the cover placement recessed portion 31 and an outer peripheral edge of the tremolo cavity 28. Furthermore, an outer peripheral edge of the magnetic force generating portion 40 substantially matches an outer peripheral edge of the cover placement recessed portion 31 and an outer peripheral edge of the metal cover 30 attached to the tremolo cavity 28.

Figure 5:
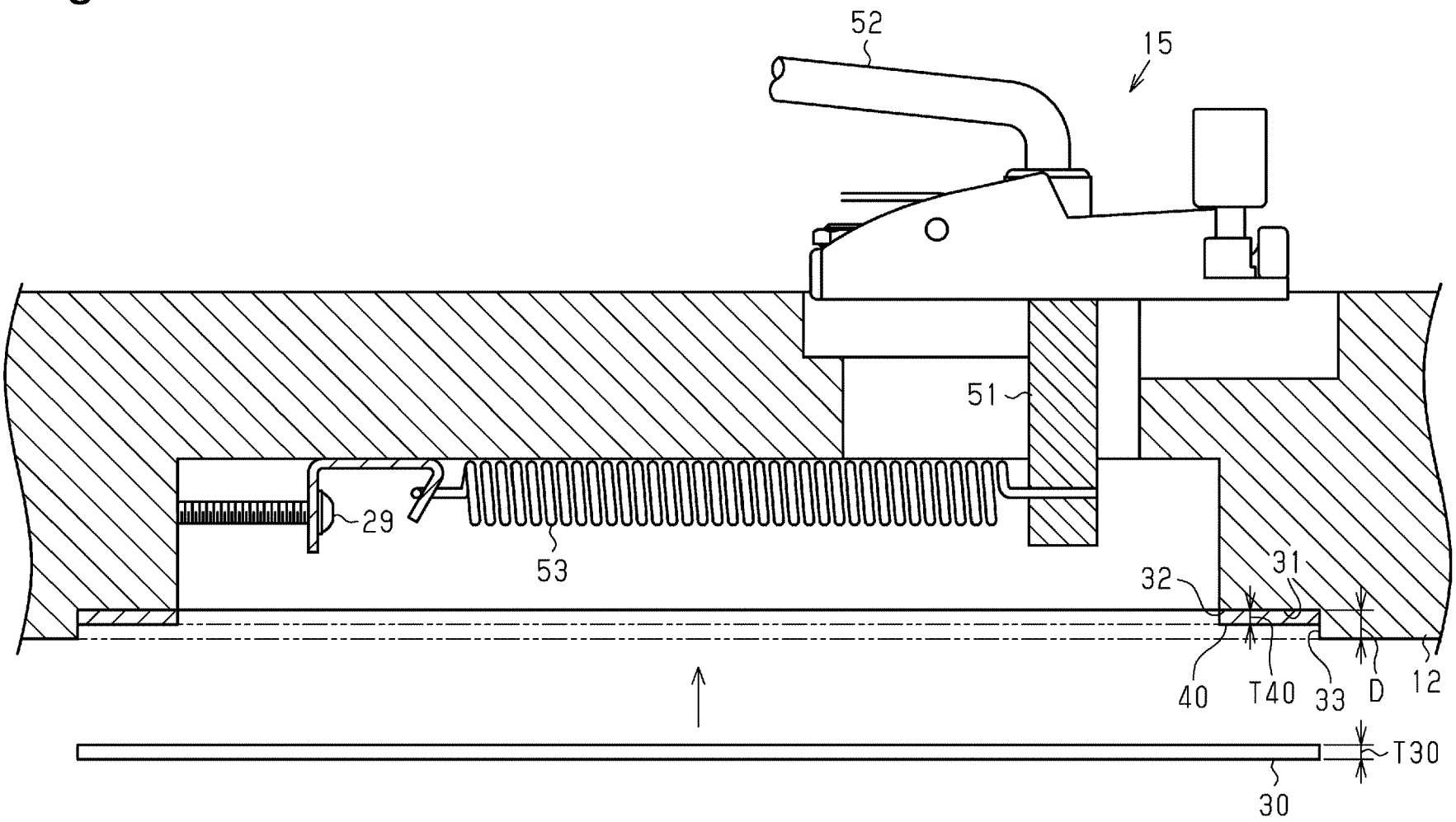
FIG. 5 is a partial cross-sectional view showing an enlargement of the vicinity of the tremolo cavity of the electric guitar.

As shown in FIGS. 4 and 5, the cover placement recessed portion 31 has a depth D from the front surface of the body 12. The depth D of the cover placement recessed portion 31 is a distance from the front surface of the body 12 to the bottom wall 32 of the cover placement recessed portion 31. The depth D of the cover placement recessed portion 31 is equivalent to a value obtained by adding a thickness T30 of the metal cover 30 to a thickness T40 of the magnetic force generating portion 40. Therefore, in a state in which the metal cover 30 is attached to the tremolo cavity 28, a front surface of the metal cover 30 is flush with the front surface of the body 12.

The metal cover 30 is made of a metallic material including a ferromagnetic material. Examples of the ferromagnetic material include iron, nickel, cobalt, ferrite, and the like. An iron alloy material is used in the metal cover 30, and stainless steel is used due to excellent workability and corrosion resistance thereof. The metal cover 30 is formed by cutting a stainless steel plate into a predetermined shape and drilling the resultant plate.

The metal cover 30 has a substantially rectangular shape with rounded corners. The metal cover 30 is formed into the same shape as the planar shape of the cover placement recessed portion 31 and formed to be slightly smaller than the cover placement recessed portion 31. A pair of holes 35 penetrating the metal cover 30 in a thickness direction is formed at the center of the metal cover 30. The pair of holes 35 functions as holders held when removing the metal cover 30 from the cover placement recessed portion 31. The shape, number, position and the like of the holes 35 are designed so as to satisfy both ease of holding the metal cover 30 and aesthetic beauty of the metal cover 30.

The operation of the electric guitar 10 described above are described next with reference to FIGS. 1, 3 and 6.

As shown in FIGS. 1 and 3, a user often adjusts the tensions of the tremolo springs 53 in order to adjust the operability of the tremolo arm 52 and the vibration sounds of the strings 14. In this case, the metal cover 30 needs to be removed from the tremolo cavity 28 in order to operate the tension adjustment mechanism 29 for the tremolo springs 53. The user can remove the metal cover 30 from the tremolo cavity 28 in the following manner, for example.

Figure 6:
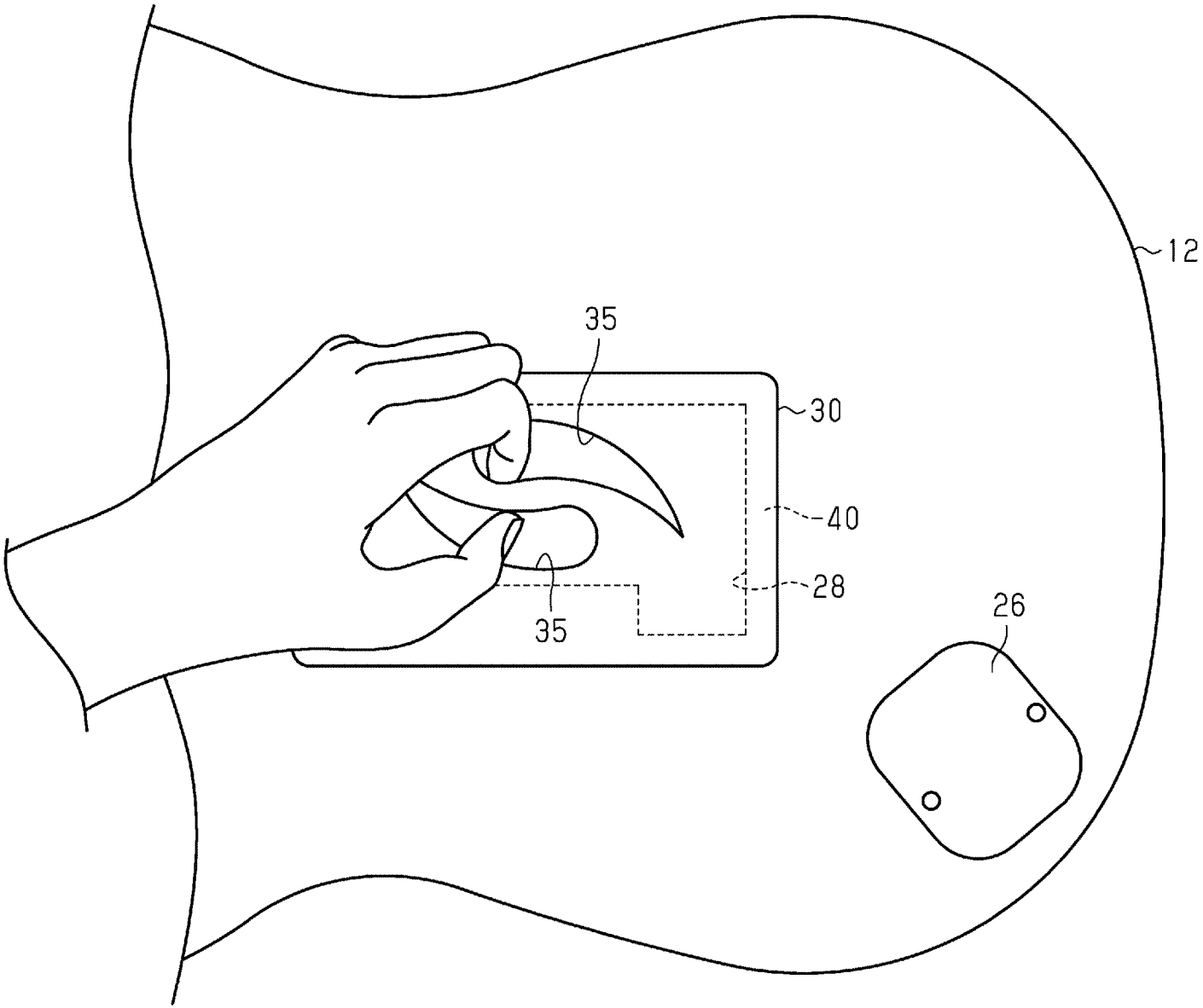
FIG. 6 is a schematic perspective view for explaining a method for attaching or removing the metal cover to or from the tremolo cavity.

As shown in FIG. 6, first, the metal cover 30 is grasped by hooking a thumb on one of the holes 35 and an index finger on the other hole 35. In this state, against the magnetic force of the magnetic force generating portion 40, the metal cover 30 is removed from the tremolo cavity 28 so as to be pulled away from the body 12. As described above, the magnetic force generating portion 40 is made out of a magnetic sheet and has a magnetic force weaker than that of a permanent magnet such as a ferrite magnet. Therefore, the user can easily remove the metal cover 30 from the tremolo cavity 28 without applying excessive force.

After adjusting the tensions of the tremolo springs 53, the metal cover 30 needs to be attached to the tremolo cavity 28. In so doing, the metal cover 30 is grasped in the same manner as when removing the metal cover 30 from the tremolo cavity 28, and the metal cover 30 is brought close to the tremolo cavity 28. As a result, the metal cover 30 is drawn to the tremolo cavity 28 by the magnetic force of the magnetic force generating portion 40. The metal cover 30 is then fitted into the cover placement recessed portion 31 and attached to the tremolo cavity 28.

According to the present embodiment, therefore, the following effects can be achieved.

(1) The magnetic force generating portion 40 that generates the magnetic force for fixing the metal cover 30 to the body 12 is provided in the vicinity of the tremolo cavity 28. According to this configuration, the magnetic force of the magnetic force generating portion 40 is used as means for fixing the metal cover 30 to the body 12 in place of a fixing tool such as a screw. In this case, by simply placing the metal cover 30 in the vicinity of the tremolo cavity 28, the metal cover 30 is fixed to the body 12 and attached to the tremolo cavity 28 by the magnetic force. In addition, the metal cover 30 can be removed from the tremolo cavity 28 so as to be pulled away from the body 12, against the magnetic force. Specifically, a troublesome task such as loosening or tightening a screw to attach or remove the metal cover 30 is not necessary. Thus, the metal cover 30 can easily be attached to or removed from the tremolo cavity 28.

(2) The metal cover 30 is made of a metallic material including a ferromagnetic material. According to this configuration, the metal cover 30 is drawn to the tremolo cavity 28 by the magnetic force of the magnetic force generating portion 40, by simply bringing the metal cover 30 close to the tremolo cavity 28. This enables the metal cover 30 to be easily placed on and attached to the tremolo cavity 28.

(3) The cover placement recessed portion 31 in which the metal cover 30 is disposed is formed on the back of the body 12. The cover placement recessed portion 31 is provided along the outer circumference of the tremolo cavity 28. According to this configuration, the metal cover 30 to be attached to the tremolo cavity 28 can easily be positioned due to the cover placement recessed portion 31. Thus, the metal cover 30 can be attached to the tremolo cavity 28 more easily.

(4) The cover placement recessed portion 31 is constituted by the bottom wall 32 facing the rear surface of the metal cover 30, and the side wall 33 facing the outer peripheral surface of the metal cover 30. The magnetic force generating portion 40 is fixed onto the bottom wall 32 of the cover placement recessed portion 31. According to this configuration, a direction in which the metal cover 30 is attached to the tremolo cavity 28 can be matched with a direction in which the metal cover 30 is drawn by the magnetic force of the magnetic force generating portion 40. Thus, the metal cover 30 can be attached to the tremolo cavity 28 more easily.

(5) The cover placement recessed portion 31 is provided along the entire circumference of the tremolo cavity 28. The magnetic force generating portion 40 is fixed to the entire surface of the bottom wall 32 of the cover placement recessed portion 31. According to this configuration, the metal cover 30 is drawn to the entire surface of the bottom wall 32 of the cover placement recessed portion 31 by the magnetic force of the magnetic force generating portion 40. Thus, not only is it possible to fix the metal cover 30 to the body 12 easily by the magnetic force but also the metal cover 30 can be prevented from easily coming off the body 12. Therefore, even during a live performance involving strenuous movements, the metal cover 30 can be prevented from easily coming off the tremolo cavity 28. Moreover, since the metal cover 30 is attached over the entire circumference of the tremolo cavity 28, foreign substances such as dust and dirt cannot easily enter the tremolo cavity 28. Therefore, adverse effects of foreign substances onto the electronic components 24 and the like can be prevented as well.

(6) The depth D of the cover placement recessed portion 31 is equivalent to the value obtained by adding the thickness T30 of the metal cover 30 to the thickness T40 of the magnetic force generating portion 40. According to this configuration, the front surface of the metal cover 30 attached to the tremolo cavity 28 can be made flush with the front surface of the body 12. Since an edge section of the metal cover 30 does not protrude, in case of the electric guitar 10 which is pressed tightly against the body of a performer and played, the edge section of the metal cover 30 does not easily get caught on clothes of the performer.

(7) The metal cover 30 has the same contour as the cover placement recessed portion 31. According to this configuration, the metal cover 30 can be attached to the cover placement recessed portion 31 in such a manner as to be fitted therein. This prevents the metal cover 30 from easily coming off the body 12, eliminating the need to use a strong magnetic force to fix the metal cover 30 to the body 12. Accordingly, the configuration of the magnetic force generating portion 40 can be simplified.

(8) The magnetic force generating portion 40 is made out of a magnetic sheet. According to this configuration, the magnetic sheet is flexible and therefore can be cut easily. Compared to a hard and brittle permanent magnet, the productivity of the magnetic force generating portion 40 can be improved. Since the magnetic sheet is an inexpensive material that can easily be obtained, the material cost can be kept low.

(9) The pair of holes 35 penetrating the metal cover 30 in the thickness direction is formed at the center of the metal cover 30. The pair of holes 35 functions as a holder held when removing the metal cover 30 from the cover placement recessed portion 31. According to this configuration, the metal cover 30 can be made lightweight since the holders are each a hole that penetrates the metal cover 30 in the thickness direction. Thus, the metal cover 30 can be attached to or removed from the tremolo cavity 28 more easily.

(10) The metal cover 30 is made of stainless steel. According to this configuration, by using stainless steel that is ferromagnetic and resistant to corrosion as the material of the metal cover 30, the function of the metal cover 30 can be retained over a long period of time.

(11) The user often attaches or removes the metal cover 30 in order to adjust the tensions of the tremolo springs 53. In this regard, the present invention is particularly useful in the electric guitar 10 having the tremolo device 15 since the present invention is configured to enable easy attachment and removal of the metal cover 30.

The present embodiment may be modified as follows.

A magnetic force generating portion that generates a magnetic force for fixing the resin cover 26 to the body 12 may be provided in the vicinity of the control cavity 25 as well so long as the influence of magnetic noise of the magnetic force generating portion is negligible. In such a case, as with the tremolo cavity 28, a cover placement recessed portion in which the resin cover 26 is disposed may be provided along an outer circumference of the control cavity 25.

The configuration of the magnetic force generating portion 40 is arbitrary as long as the magnetic force for fixing the metal cover 30 to the body 12 can be generated. For example, other than a magnetic sheet, a permanent magnet such as a ferrite magnet may be used as the magnetic force generating portion 40. Furthermore, the electric guitar 10 may be configured in such a manner that the metal cover 30 is fixed to the body 12 by means of an electromagnet that becomes magnetic when turned on and electricity passes therethrough.

Although the magnetic force generating portion 40 made out of a magnetic sheet is provided in the vicinity of the tremolo cavity 28 and the tremolo cavity cover is used as the metal cover 30, the magnetic force generating portion 40 may be provided on the tremolo cavity cover. In this case, the tremolo cavity cover may be configured as the resin cover, the magnetic force generating portion 40 made out of a magnetic sheet may be provided on a rear surface of the tremolo cavity cover, and then a stainless steel plate may be fixed onto the bottom wall 32 of the cover placement recessed portion 31.

The cover placement recessed portion 31 may be omitted, and the metal cover 30 may be fixed directly to the front surface of the body 12. In such a case, a magnetic sheet or a permanent magnet may be fixed to a position in the front surface of the body 12, to which the metal cover 30 is attached. Also, in this case, the magnetic sheet or the permanent magnet may be stuck to the front surface of the body 12 using an adhesive or a double-sided tape or may be embedded in a recessed portion formed on the front surface of the body 12.

Although the magnetic force generating portion 40 is provided on the bottom wall 32 of the cover placement recessed portion 31, the magnetic force generating portion 40 may be provided on the side wall 33 of the cover placement recessed portion 31. The magnetic force generating portion 40 may be provided in both the bottom wall 32 and the side wall 33 of the cover placement recessed portion 31.

Figure 7A:
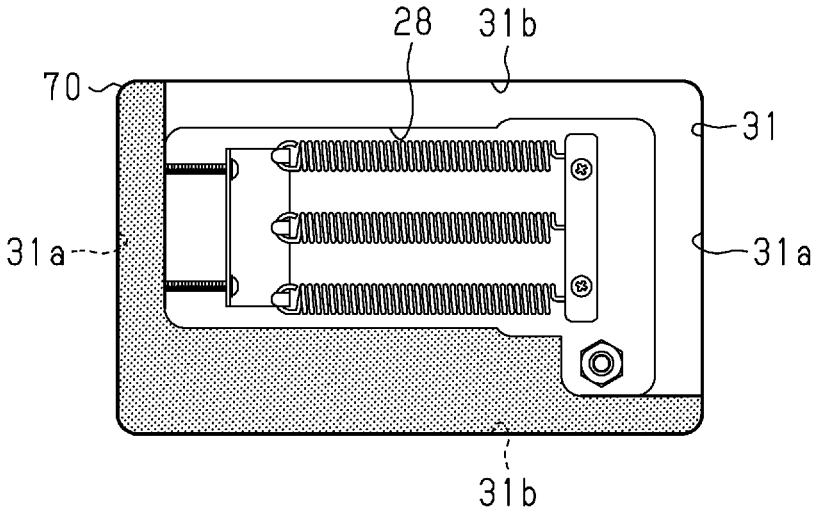
FIG. 7A is a plan view showing the magnetic force generating portion according to another example.
Figure 7B:
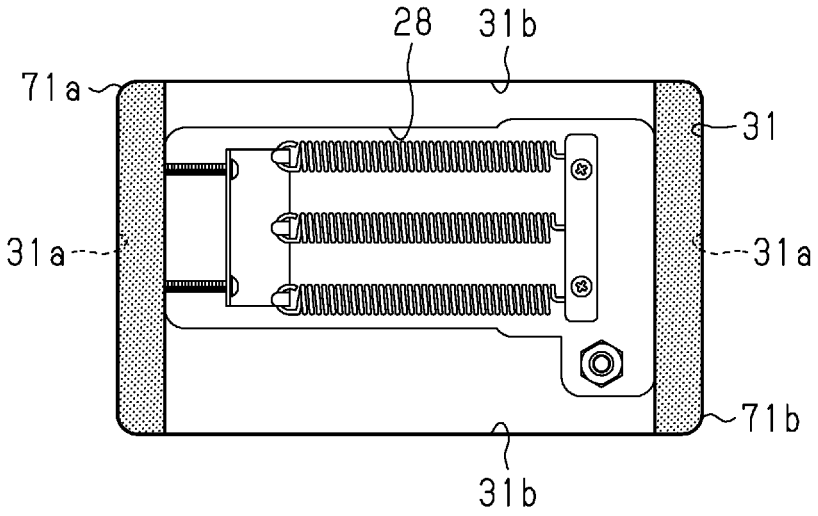
FIG. 7B is a plan view showing the magnetic force generating portion according to another example.

As long as the metal cover 30 can be fixed to the body 12 using magnetic force, the magnetic force generating portion 40 may be provided only in a part of the cover placement recessed portion 31 instead of the entire circumference of the cover placement recessed portion 31. For example, as shown in FIG. 7A, a substantially L-shaped magnetic force generating portion 70 may be provided in the cover placement recessed portion 31 in such a manner as to extend across a left-side first recessed portion 31*a* and a lower-side second recessed portion 31*b*. Also, as shown in FIG. 7B, magnetic force generating portions 71*a*, 71*b* may be provided in a pair of left and right first recessed portions 31*a* in the cover placement recessed portion 31. Alternatively, a magnetic force generating portion may be provided in each of upper and lower second recessed portions 31*b* in the cover placement recessed portion 31.

The depth D of the cover placement recessed portion 31 may be equal to or greater than the value obtained by adding the thickness T30 of the metal cover 30 to the thickness T40 of the magnetic force generating portion 40. In this case, the front surface of the metal cover 30 attached to the tremolo cavity 28 can be positioned slightly lower than the front surface of the body 12. In addition, even when the edge section of the metal cover 30 protrudes but does not get in the way of the performance, the depth D of the cover placement recessed portion 31 may be smaller than the value obtained by adding the thickness T30 of the metal cover 30 to the thickness T40 of the magnetic force generating portion 40.

The contours of the cover placement recessed portion 31, the metal cover 30, and the resin cover 26 are arbitrary and therefore may be polygons such as triangles other than squares, or circles or ovals.

In addition to the holes 35 configured to allow fingers to be hooked thereon, the holders provided in the metal cover 30 may each be a protrusion configured to be pinched by fingers.

Other than the electric guitar 10, the examples of the electric string instrument may also include electric bass guitars, electric violins, electric harps, and electric mandolins.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. An electric string instrument that converts a vibration of a string into an electric signal and outputs the electric signal, the electric string instrument comprising:

a body on which the string is stretched; and components that are provided in the body and used for outputting the electric signal or playing the electric string instrument, wherein the body comprises:

a component accommodating recessed portion for accommodating the components;

a cover configured to be attached to the component accommodating recessed portion;

a magnetic force generating portion that generates a magnetic force for fixing the cover to the body; and a cover placement recessed portion in which the cover is disposed, the cover placement recessed portion is provided along an outer circumference of the component accommodating recessed portion, the cover placement recessed portion is constituted by a bottom wall facing a rear surface of the cover, and a side wall facing an outer peripheral surface of the cover, the magnetic force generating portion is provided on the bottom wall, the cover placement recessed portion is provided over an entire circumference of the component accommodating recessed portion, and the magnetic force generating portion is provided on an entire surface of the bottom wall of the cover placement recessed portion.

2. The electric string instrument according to claim 1, wherein the magnetic force generating portion is provided in the vicinity of the component accommodating recessed portion, and the cover is made of a metallic material including a ferromagnetic material.

3. The electric string instrument according to claim 1, wherein the cover placement recessed portion has a depth from a front surface of the body, the depth of the cover placement recessed portion being equal to or greater than a value obtained by adding a thickness of the cover to a thickness of the magnetic force generating portion (40).

4. The electric string instrument according to claim 1, wherein a contour of the cover placement recessed portion is the same as a contour of the cover.

5. The electric string instrument according to claim 1, wherein the magnetic force generating portion is made out of a flexible magnetic sheet.

6. The electric string instrument according to claim 1, wherein the cover is provided with a holder that is held to remove the cover from the component accommodating recessed portion, the holder being constituted by a hole penetrating the cover in a thickness direction.

7. The electric string instrument according to claim 1, wherein the cover is made of stainless steel.

8. The electric string instrument according to claim 1, wherein the component is a tremolo device installed in an electric guitar or an electric bass guitar.

* * * * *